United States Patent [19]

Kinoshita et al.

[11] Patent Number: 4,983,309

[45] Date of Patent: Jan. 8, 1991

[54] LUBRICANTS FOR COTTON SPINNING

[75] Inventors: Tsukasa Kinoshita; Tomohiro Kato, both of Aichi, Japan

[73] Assignee: Takemoto Yushi Kabushiki Kaisha, Aichi, Japan

[21] Appl. No.: 334,796

[22] Filed: Apr. 5, 1989

Related U.S. Application Data

[63] Continuation-in-part of Ser. No. 103,517, Oct. 1, 1987, abandoned.

[30] Foreign Application Priority Data

Oct. 3, 1986 [JP] Japan ..... 61-236550

[51] Int. Cl.[5] ..... D02G 3/00

[52] U.S. Cl. ..... 252/8.6; 252/8.8; 57/258; 427/391; 427/392; 427/393

[58] Field of Search ..... 252/8.6, 8.8; 427/391, 427/392, 393, 378, 387, 428; 57/258

[56] References Cited

U.S. PATENT DOCUMENTS 3,828,087 8/1974 Pittman ..... 260/448.2 B
4,129,694 12/1978 Cogliano ..... 521/107
4,283,519 8/1981 Pines ..... 528/26
4,563,288 1/1986 Bauman ..... 252/8.8
4,756,714 7/1988 Hendrix ..... 8/115.6

OTHER PUBLICATIONS

Chemical Abstracts, vol. 94, 104837k, p. 104846 (1981).

*Primary Examiner*—John F. Niebling
*Assistant Examiner*—Isabelle R. McAndrews
*Attorney, Agent, or Firm*—Flehr, Hohbach, Test, Albritton & Herbert

[57] ABSTRACT

For cotton spinning, use is made of a treatment agent containing silicone with viscosity at 25° C. of 10 centistokes or greater such as dimethylsilicone, end hydroxy modified dimethylsilicone or epoxy modified dimethylsilicone and an emulsifier such as polyoxyethylene alkylether or polyoxyethylene alkylphenylether. The treatment agent may also contain a cationic or non-ionic surface-active agent within a specified range of weight ratio. The treatment agent is applied to raw cotton during its bale opening or beating opener process at the rate of 0.001–2.0 wt %.

12 Claims, No Drawings

LUBRICANTS FOR COTTON SPINNING

BACKGROUND OF THE INVENTION

This is a continuation-in-part of application Ser. No. 103,517 filed Oct. 1, 1987.

This invention relates to a pre-treatment method of raw cotton.

For the spinning of fibers other than cotton such as wool, chemical fibers and synthetic fibers, a lubricant of some sort is generally used in order to improve their characteristics. For cotton spinning, by contrast, lubricants are usually not used because cotton by nature is basically suited for spinning in terms, for example, of cotton wax, fiber shapes, fiber lengths, fineness, and fiber hygroscopicity. With the increase in the speed and size of the spinning machines in recent years, however, characteristics of synthetic fibers regarding spinning have significantly improved. For cotton spinning, too, it is coming to be considered insufficient to depend merely on the natural characteristics of cotton and it is desirable to further improve spinning characteristics by applying an appropriate treatment agent prior to the spinning. The present invention, therefore, relates to a method of pre-treatment of raw cotton which can respond to such requirements.

In cotton spinning mills or ginning factories, some treatment agents such as dust control agents based on a mineral oil with low viscosity and cationic surface active agents for dust reduction have been studied. Improvement of productivity in gin factories and inorganic agents of a certain kind for increasing friction to improve yarn strength and spinning characteristics have also been studied. These agents, however, generally do not improve the spinning characteristics of cotton partially because they are primarily for different purposes.

A particular problem in cotton spinning is its tendency to become wrapped around rollers. Although this tendency is greatly influenced by many characteristics of raw cotton, it is particularly a problem with raw cotton with a large quantity of honeydew. As means for improving the processability of raw cotton, washing and corona discharge methods have been reported but they cannot sufficiently prevent raw cotton from becoming wrapped around the rollers and there is yet to be discovered an effective method against this problem. The methods which are currently being used in cotton spinning factories hardly go beyond reducing the temperature and humidity of the environment, or in the case of raw cotton with a large quantity of honeydew, mixing it with raw cotton with little honeydew and spinning them together. The recent requirements to significantly improve the spinning characteristics of cotton cannot be satisfied by such processes and the cost of energy in the operation increases inevitably if temperature and humidity must be reduced.

SUMMARY OF THE INVENTION

It is therefore an object of the present invention to eliminate the problems described above by providing a method of treatment which restrains not only ordinary raw cotton but also raw cotton with honeydew from wrapping around rollers even if temperature and humidity are not particularly controlled.

It is another object of the present invention to provide treatment agents as described above which reduce the cost of energy in processing such raw cotton.

The present invention has been completed by the present inventors who, as a result of diligent studies with the aforementioned objectives, discovered that (1) hygroscopicity of raw cotton with a large quantity of honeydew increases at high humidity and the coefficient of kinetic friction between fibers and rubber rollers increases abnormally, that (2) if a treatment agent containing silicone with viscosity in a specific range is applied to raw cotton, the rise in the coefficient of kinetic friction between fibers and rubber rollers can be controlled even at high humidity and the amount of fibers which is wrapped around the rollers can be reduced, this effect being particularly noteworthy with raw cotton wi&:h a large quantity of honeydew, and that (3) the wrapping of fibers around rollers can be prevented even more effectively if silicone of the aforementioned kind is used as an emulsion and with a certain type of surface active agent.

DETAILED DESCRIPTION OF THE INVENTION

This invention relates to pre-treatment methods in cotton spinning which are characterized by the step of applying a treatment agent of a special kind to raw cotton during its bale opening or beating opener process at 0.001–2.0 wt% by its silicone component. The treatment agent according to the present invention is an aqueous emulsion. According to a first embodiment of the present invention, the aqueous emulsion to be used is characterized as containing as solid component (1) silicone with viscosity at 25° C. of 10cst or greater selected from the group consisting of dimethylsilicone, end hydroxy modified dimethylsilicone and epoxy modified dimethylsilicone, and (2) an emulsifier selected from the group consisting of polyoxyethylene alkylether and polyoxyethylene alkylphenylether. The emulsifier is 15 wt% or less with respect to the solid component.

According to a second embodiment of the present invention, the aqueous emulsion to be used is characterized as containing as solid component (1) silicone with viscosity at 25° C. of 10cst or greater selected from the group consisting of dimethylsilicone, end hydroxy modified dimethylsilicone and epoxy modified dimethylsilicone, (2) a cationic surface-active agent shown by the formula:

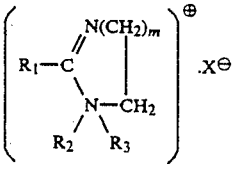

where m is 1 or 2; X is halogen, $CH_3SO_4$, $C_2H_5SO_4$, $NO_3$, $NO_2$ or $H_2PO_4$; $R_1$ is alkyl or alkenyl group with 11–21 carbon atoms or alkyl group with 1 or 2 carbon atoms; $R_2$ is alkyl group with 1 or 2 carbon atoms; R3 is $C_nH_{2n+1}OH$, $C_nH_{2n+1}NH_2$ or $C_nH_{2n+1}NHCOR_4$; $R_4$ is alkyl or alkenyl group with 11–21 carbon atoms or alkyl group with 1 or 2 carbon atoms; and n is 2 or 3; at least one of $R_1$ and $R_4$ being alkyl or alkenyl group with 11–21 carbon atoms, and (3) an emulsifier which is to be added if necessary, and is selected from the group consisting of polyoxyethylene alkylether and polyoxyethylene alkylphenylether. The weight ratio between the silicone and cationic surface active agent parts is 80/20

- 40/60 and the ratio of the emulsifier part to the solid component is 15 wt% or less.

According to a third embodiment of the present invention, the aqueous emulsion to be used is characterized as containing as solid component (1) silicone with viscosity at 25° C. of 10cst or greater selected from the group consisting of dimethylsilicone, end hydroxy modified dimethylsilicone and epoxy modified dimethylsilicone, (2) a non-ionic surface-active agent selected from the group consisting of ethylene oxide 10–50 mole adducts of castor oil or of hydrogenated castor oil, and (3) an emulsifier which is to be added if necessary and is selected from the group consisting of polyoxyethylene alkylether and polyoxyethylene alkylphenylether. The weight ratio between the silicone and non-ionic surface active agent parts is 80/20 - 60/40 and the ratio of the emulsifier to the solid component is 15 wt% or less.

In the process of spinning raw cotton and particularly under a condition of high humidity, silicone with viscosity of 10 cst or greater reduces the increase in the coefficient of kinetic friction between the fibers and rubber rollers caused by increased hygroscopicity and the wrapping of the fibers around the rollers caused by this increase in friction. Silicones with viscosity below 10 cst hardly have this effect of reducing the wrapping around the rollers. Silicones with viscosity in the range of 100–500,000 cst are the most preferable. Among silicones with viscosity of 10 cst or greater, reactive silicones such as end hydroxy modified silicones and epoxy modified silicones are particularly preferable.

Silicones of the type described above are used in the form of a silicone emulsion. Such a silicone emulsion can be obtained by emulsion polymerization or alternatively by adding an emulsifier to a silicone oil to form a water emulsion with the help of a mechanical means. The amount of emulsifier to be used for obtaining a silicone emulsion should be less than 15 wt% with respect to the treatment agent as a whole. If more that 15 wt% of certain emulsifier is contained, the effect of reducing roller wrapping and the fiber opening property may be adversely affected. Emulsifiers for silicone used in present invention are polyoxyethylene (hereinafter abbreviated as POE), alkylphenylether and POE alkylether.

If a cationic surface-active agent shown by the formula (A) is used together, treatment of the present invention is particularly effective not only in reducing the wrapping of fibers around rollers but also against the generation of static electricity during spinning processes. Cationic surface-active agents interact with the honeydew attached to raw cotton and somehow reduces its hygroscopicity. The wrapping of fibers around rollers is further reduced by the reduction in hygroscopicity in addition to the effect of reduction in the coefficient of friction between the fibers and the rubber rollers.

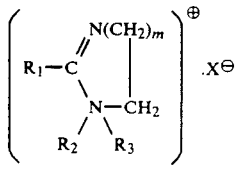

where m is 1 or 2; X is halogen, $CH_3SO_4$, $C_2H_5SO_4$, $NO_3$, $NO_2$ or $H_2PO_4$; $R_1$ is alkyl or alkenyl group with 11–21 carbon atoms or alkyl group with 1 or 2 carbon atoms; $R_2$ is alkyl group with 1 or 2 carbon atoms; $R_3$ is $C_nH_{2n+1}OH$, $C_nH_{2n+1}NH_2$ or $C_nH_{2n+1}NHCOR_4$; $R_4$ is alkyl or alkenyl group with 11–21 carbon atoms or alkyl group with 1 or 2 carbon atoms; and n is 2 or 3; at least one of $R_1$ and $R_4$ being alkyl or alkenyl group with 11–21 carbon atoms.

To recapitulate, either $R_1$ or $R_4$ in the cationic surface-active agent considered herein must be an alkyl or alkenyl group with 11–21 carbon atoms. If the length of this alkyl chain is no greater than 10 carbon atoms, the aforementioned ability to reduce hygroscopicity is small. If it is 22 or more carbon atoms, on the other hand, it compatibility with silicone becomes worse and its antistatic characteristic is also adversely affected. These cationic surface-active agents show superior results if they are used at the silicone/cationic surfaceactive agents weight ratio of 80/20 - 40/60. Outside this range, effects of their combined use become unrecognizable.

Treatment of the present invention can not only reduce the wrapping of fibers around rollers, but also improve cohesion in various steps of the spinning process, reduce yarn breakage and improve yarn strength if a non-ionic surface-active agent of a specific type (ethylene oxide 10–50 moles adduct of castor oil or of hydrogenated castor oil) is used together. These non-ionic surface-active agents show superior results if they are used at the silicone/agent weight ration of 80/20 60/40. Outside this range, effects of their combined use become unrecognizable.

Treatment of the present invention by using the agents described above shows favorable effects even if only a small amount is applied to raw cotton compared to the ordinary spinning oil. They are applied at 0.001–2.0 wt% as silicone component but application at the rate in the range of 0.003–0.2 wt% is sufficient. The rate should be changed generally according to the quality of raw cotton (fineness, fiber length, matters attached on the surface, etc.).

Treatment agents of this invention may be applied to raw cotton during the bale opening process or during the beating opener process. For example, lubrication may be considered most appropriate. When treatment agents of the present invention are applied, care must be taken also to apply them as uniformly as possible in order to maximize their effects. Application of too much water to raw cotton is not desirable because it tends to adversely affect the filament opening and draft characteristics and increase adhesiveness. Accordingly, it is preferable to prepare an emulsion of relatively high concentration and apply as little as possible by a usual spraying method. It is also preferable to dry raw cotton processed by an aqueous emulsion and, more particularly, to dry raw cotton after a treatment agent with end hydroxy modified dimethyl silicone or epoxy modified dimethyl silicone is applied. The raw cotton may be dried naturally, but superior results can be obtained by a hot-air forced drying process.

As discussed above, raw cotton with a large quantity of so-called honeydew is not usable because it wraps around rollers easily. It has not been clearly understood, however, why honeydew causes this to happen. What is generally referred to as honeydew may be different, depending on where the raw cotton was produced and how it was grown but it is generally considered to be a water-soluble substance having sugar materials from insects or cotton itself. It is believed that honeydew absorbs moisture from the atmosphere to increase its stickiness because it is both sticky and highly hygroscopic. Against the problem of roller wrapping, experience with synthetic fibers may be consulted. Thus, one may consider mineral oils and esters of aliphatic acids which are hydrophobic lubricants with low viscosity, various types of wax, alkylsulfates and alkylphosphates with 16 or more carbon atoms which are treatment agents with high melting points and low hygroscopicity and other treatment agents believed to reduce hygroscopicity. None of the above, however, was found to be significantly effective against roller wrapping according to the experiments of the present inventors, who, instead, discovered that the coefficient of friction between fibers and rubber increases peculiarly in the case of cotton with a large quantity of honeydew if humidity is increased and that the lubricants of the present invention can reduce the effect of this phenomenon, preventing fibers from wrapping around rollers.

Table 1 shows the results of experiments whereby yarns (1/20) of four cotton samples a–d to be described below were used to evaluate their wrapping tendencies during drawing and to measure the frictional tension between fibers (F/F) between fibers and a metal (F/M) and between fibers and rubber (F/R) with initial tension $T_1 = 10$ gram force in all cases:

a: raw cotton with a small quantity of honeydew (weak Benedicts test)

b: raw cotton with a large quantity of honeydew (strong Benedicts rest)

c: b treated during bale opening process with dimethylsilicone (viscosity = 10,000 cst) emulsion (solid component being 90 wt% of silicone and 10 wt% of POE (10) nonylphenylether) by 0.03 wt% d: b treated during bale opening process with Milube N-32 (produced by George A. Goulstone Co.) by 0.05 wt%

TABLE 1

| Sample | Drawing Roller Wrapping 25° C. × 45% RH | Drawing Roller Wrapping 25° C. × 75% RH | Kinetic Friction (g) 25° C. × 45% RH F/F | F/M | F/R | 25° C. × 75% RH F/F | F/M | F/R |
|---|---|---|---|---|---|---|---|---|
| a | small | medium | 48 | 52 | 62 | 65 | 67 | 102 |
| b | medium | large | 50 | 55 | 69 | 80 | 80 | 168 |
| c | small | small | 44 | 51 | 60 | 61 | 58 | 64 |
| d | small | large | 48 | 52 | 64 | 73 | 61 | 174 |

Table 1 shows that raw cotton wraps easily around rollers during spinning processes under a high humidity condition. This phenomenon becomes extremely noticeable with raw cotton with a large amount of honeydew and spinning may become practically impossible. Table 1 suggests that this is caused by the corresponding increase in the frictional tension between fibers and rubber rollers. Although agents based on a hydrophobic lubricant are generally effective with other types of fibers, they hardly have any effect on the roller wrapping of raw cotton under humid conditions caused by an increase in the friction between fibers and rubber. Such effects are observable only with silicone components of the present invention (Sample C).

In what follows results of experiments are shown in order to more clearly describe the details and effects of the present invention.

PART 1 OF TESTING

(1) Preparation of Samples

The following treatment agents according to the present invention (Test Examples 1–11) and other lubricants for comparison (Comparison Examples 1–9) to be described below were applied respectively to 2.0kg of raw cotton comprised of 40% of American cotton, 20% of Nicaraguan cotton, 30% of Pakistan cotton and 10% of Chinese cotton during bale opening process by a spraying method in the form of a 3% (active content) emulsion. Drying operation was not carried out. Thereafter, the results were evaluated for the cases of drawing, roving and spinning as will be described below. This, together with the amount of treatment agent applied (in wt%), is shown in Table 2.

Comparison Example 1

No treatment agents

Comparison Example 2

60 wt parts of liquid paraffin (15cst), 30 wt parts of methyloleate and 10 wt parts of polyoxyethylene (6 moles) nonylphenylether

Comparison Example 3

90 wt parts of 125° F. paraffin wa, 3 wt parts of sorbitan monostearate and 7 wt parts of polyoxyethylene (18 moles) olylether

Comparison Example 4

95 wt parts of dimethylsilicone (7cst) and 5 wt parts of POE (15 moles) stearylether

Comparison Example 5

40 wt parts of dimethylsilicone (1000cst) and 60 wt parts of POE (15 moles) nonylphenylether

Test Example 1

95 wt parts of dimethylsilicone (20cst) and 5 wt parts of POE (15 moles) oleylether

Test Example 2

90 wt parts of dimethylsilicone (1000 cst) and 10 wt parts of POE (15 moles) nonylphenylether

Test Example 3

95 wt part of end hydroxy dimethylsilicone (100000cst) and 5 wt parts of POE (15 moles) stearylether

Test Example 4

Same as Test Example 3

Test Example 5

90 wt parts of epoxy modified dimethylsilicone (500cst) and 10 wt parts of POE (24 moles) nonylphenylether

Comparison Example 6

1-(2-hydroxyethyl)-1-ethyl-2-undecyl-2-imidazolinium ethylsulfate

Comparison Example 7

5 wt parts of end hydroxy dimethylsilicone (100000cst), 50 wt parts of POE (15 moles) stearylether and 45 wt parts of 1-(2-hydroxyethyl)-1-ethyl-2-undecyl-2-imidazolinium ethylsulfate Test Example 6

40 wt parts of end hydroxy dimethylsilicone (100000cst) and 60 wt parts of 1-(2-hydroxyethyl)-1-ethyl-2-undecyl-2-imidazolinium ethylsulfate Test Example 7

60 wt parts of end hydroxy dimethylsilicone (100000cst) and 40 wt parts of 1-(2-hydroxyethyl)-1-ethyl-2-undecyl-2-imidazolinium ethylsulfate Test Example 8

80 wt parts of dimethylsilicone (10000cst) and 20 wt parts of 1-(2-hydroxyethyl)-1-ethyl-2-undecyl-2-imidazolinium ethylsulfate Comparison Example 8

Castor oil ethylene oxide (25 moles) adduct

Comparison Example 9

25 wt parts of dimethylsilicone (10000cst) and 75 wt parts of castor oil ethylene oxide (25 moles) adduct Test Example 9

80 wt parts of dimethylsilicone (10000cst) and 20 wt parts cf castor oil ethylene oxide (25 moles) adduct Test Example 10

70 wt parts of dimethylsilicone (1000cst) and 30 wt parts of hydrogenated castor oil ethylene oxide (12 moles) adduct Test Example 11

60 wt parts of end hydroxy dimethylsilicone (100000cst), 35 wt parts of castor oil ethylene oxide (50 moles) adduct and 5 wt parts of POE (8 moles) nonylphenylether (2) Conditions of Spinning Processes (1) Drawing Temperature and humidity: 25° C.×70% RH
Density of feed sliver: 467 grain/6yd
Delivery speed: 200 m/minute
Total Draft Ratio: 8.0 (times/1 head), 8.0 (times/2 head), 8.0 (times/3 head)

(2) Roving

Temperature and humidity: 25° C.×70% RH
Density of delivery sliver: 250 grain/30yd
Twist Number: 0.8 turns/inch (3) Spinning Temperature and humidity: 25° C.×70% RH
Spindle rotation: 13500 rpm
Total Draft Ratio: 20.0 times
Twist Number: 17.9 turns/inch
Yarn Count: 20

(3) Tested Items (1) Roller wrapping

The total number of wrap turns around each drawing roller when sample cotton was passed three times described test conditions (2) Strength and elongation of single yarns Results of measurement No. 20 single yarn processed under the aforementioned conditions according to the JIS-L1008-5-5 method

TABLE 2

| | Application (wt %) | Silicone in Applied Oil (wt %) | Wrapping | Strength (g) | Elongation (%) |
|---|---|---|---|---|---|
| Comp. 1 | — | 0 | 31 | 277 | 5.5 |
| Comp. 2 | 0.5 | 0 | 33 | 266 | 5.4 |
| Comp. 3 | 0.5 | 0 | 26 | 264 | 5.5 |
| Comp. 4 | 0.05 | 0.0475 | 24 | 256 | 5.5 |
| Comp. 5 | 0.05 | 0.02 | 19 | 262 | 5.3 |
| Test 1 | 0.005 | 0.00475 | 12 | 270 | 5.6 |
| Test 2 | 0.05 | 0.0475 | 8 | 274 | 5.7 |
| Test 3 | 0.005 | 0.00475 | 10 | 277 | 5.5 |
| Test 4 | 0.1 | 0.095 | 6 | 265 | 5.6 |
| Test 5 | 0.05 | 0.045 | 3 | 272 | 5.7 |
| Comp. 6 | 0.1 | 0 | 22 | 270 | 5.7 |
| Comp. 7 | 0.05 | 0.0025 | 23 | 268 | 5.5 |
| Test 6 | 0.003 | 0.0012 | 3 | 270 | 5.4 |
| Test 7 | 0.05 | 0.03 | 0 | 275 | 5.6 |
| Test 8 | 0.1 | 0.08 | 2 | 274 | 5.5 |
| Comp. 8 | 0.2 | 0 | 38 | 283 | 5.6 |
| Comp. 9 | 0.05 | 0.0125 | 21 | 279 | 5.6 |
| Test 9 | 0.05 | 0.04 | 1 | 274 | 5.7 |
| Test 10 | 0.05 | 0.035 | 2 | 280 | 5.8 |
| Test 11 | 0.05 | 0.03 | 0 | 278 | 5.6 |

Table 2 shows that the present invention can significantly improve the spinability characteristics of cotton. Yarns of superior quality can thus be produced. Table 2 also shows that this improvement is obtained even under a high humidity condition and equally well with raw cotton with honeydew.

PART 2 OF TESTING

After 3.0% emulsions of the following four treatment agents (A–D) were applied to Sudanese raw cotton individually at 0.3 wt% (as silicone component), the cotton samples were dried forcibly by hot air at 105° C. for 30 minutes. Next, after they were left for 24 hours inside a room controlled at 25° C. and 80%RH, their adhesiveness was examined by handling. Similar examinations were also carried out on samples which were naturally dried for 24 hours inside a room controlled at 20° C. and 65%RH. The results of these sensory inspection tests are shown in Table 3.

Agent A 80 wt parts of dimethylsilicone (10000cst) and 20 wt parts of 1-(2-hydroxyethyl)-1-ethyl-2-heptadecyl-2-imidazolinium ethylsulfate Agent B 80 wt parts of end hydroxy dimethylsilicone (10000cst) and 20 wt parts of 1-(2-hydroxyethyl)-1-ethyl-2-heptadecyl-2 -imidazolinium ethylsulfate Agent C 80 wt parts of epoxy modified dimethylsilicone (500cst) and 20 wt parts of 1-(2-hydroxyethyl)-1-ethyl-2- heptadecyl-2-imidazolinium ethylsulfate Agent D 80 wt parts of polyethylene glycol modified dimethylsilicone (molecular weight=5000 and viscosity=2000cst) and 20 wt parts of 1-(2-hydroxyethyl)-1-ethyl-2-heptadecyl-2-imidazolinium ethylsulfate

TABLE 3

| Agent | Natural Drying 25° C. × 24 h | Hot-air Drying 105° C. × 30 min. |
|---|---|---|
| A | "B" | "B" |
| B | "B"-"A" | "A" |
| C | "B"-"A" | "A" |
| D | "C"-"D" | "C"-"D" |

In Table 3, the results of sensory inspection by handling are expressed as follows:

"A": Extremely clean feeling

"B": Clean felling with no stickiness

"C": Slightly sticky feeling

"D": Significantly sticky feeling

What is claimed is:

1. A pre-treatment method in cotton spinning consisting of the step of applying a treatment agent to raw cotton during a bale opening or beating opener process of said raw cotton at 0.001–2.0 wt% by silicone component thereof, said treatment agent being an aqueous emulsion which contains as solid component silicone with viscosity at 25° C. of 10cst or greater selected from the group consisting of dimethylsilicone, end hydroxy modified dimethylsilicone and epoxy modified dimethylsilicone, and an emulsifier selected from the group consisting of polyoxyethylene alkylether and polyoxyethylene alkylphenylether, said emulsifier being 15 wt % or less with respect to said solid component.

2. The method of claim 1 wherein said silicone is end hydroxy modified dimethylsilicone or epoxy modified dimethylsilicone.

3. The method of claim 2 further comprising the step of drying said raw cotton after said step of applying treatment agent.

4. The method of claim 3 wherein said drying step comprises drying by forced hot-air drying.

5. A pre-treatment method in cotton spinning consisting of the step of applying a treatment agent to raw cotton during a bale opening or beating opener process of said raw cotton at 0.001–2.0 wt% by silicone component thereof, said treatment agent being an aqueous emulsion which contains as solid component silicone with viscosity at 25° C. of 10cst or greater selected from the group consisting of dimethylsilicone, end hydroxy modified dimethylsilicone and epoxy modified dimethylsilicone, a cationic surface-active agent shown by the formula:

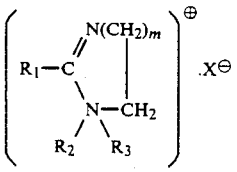

where m is 1 or 2; X is halogen, $CH_3SO_4$, $C_2H_5SO_4$, $NO_3$, $NO_2$ or $H_2PO_4$; $R_1$ is alkyl or alkenyl group with 11–21 carbon atoms or alkyl group with 1 or 2 carbon atoms; $R_2$ is alkyl group with 1 or 2 carbon atoms; $R_3$ is $C_nH_{2n+1}OH$, $C_nH_{2n+1}NJ_2$ or $C_nH_{2n+1}NHCOR_4$; $R_4$ is alkyl or alkenyl group with 11–21 carbon atoms or alkyl group with 1 or 2 carbon atoms; and n is 2 or 3; at least one of $R_1$ and $R_4$ being alkyl or alkenyl group with 11–21 carbon atoms, and an emulsifier which is to be added if necessary, said emulsifier being selected from the group consisting of polyoxyethylene alkylether and polyoxyethylene alkylphenylether, and weight ratio between said silicone and said cationic surface active agent being 80/20 - 40/60 and the ratio of said emulsifier to said solid component being 15 wt% or less.

6. The method of claim 5 wherein said silicone is end hydroxy modified dimethylsilicone or epoxy modified dimethylsilicone.

7. The method of claim 6 further comprising the step of drying said raw cotton after said step of applying treatment agent.

8. The method of claim 7 wherein said drying step comprises drying by forced hot-air drying.

9. A pre-treatment method in cotton spinning consisting of the step of applying a treatment agent to raw cotton during a bale opening or beating opener process of said raw cotton at 0.001–2.0 wt % by silicone component thereof, said treatment agent being an aqueous emulsion which contains as solid component silicone with viscosity at 25° C. of 10cst or greater selected from the group consisting of dimethylsilicone, end hydroxy modified dimethylsilicone and epoxy modified dimethylsilicone, a non-ionic surface-active agent selected from the group consisting of ethylene oxide 10–50 mole aducts of castor oil or of hydrogenated castor oil, and an emulsifier which is to be added if necessary, said emulsifier being selected from the group consisting of polyoxyethylene alkylether and polyoxyethylene alkylphenylether, the weight ratio between said silicone and said non-ionic surface active agent being 80/20 - 60/40 and the ratio of said emulsifier to said solid component being 15 wt% or less.

10. The method of claim 9 wherein said silicone is end hydroxy modified dimethylsilicone or epoxy modified dimethylsilicone.

11. The method of claim 10 further comprising the step of drying said raw cotton after said step of applying treatment agent.

12. The method of claim 11 wherein said drying step comprises drying by forced hot-air drying.

* * * * *